US008220392B1

(12) United States Patent
Maldonado et al.

(10) Patent No.: US 8,220,392 B1
(45) Date of Patent: Jul. 17, 2012

(54) LAUNCHABLE GRENADE SYSTEM

(75) Inventors: Edgardo Maldonado, Orlando, FL (US); Daniel J. Hartman, Orlando, FL (US); Noel Gonzalez, Oviedo, FL (US); William G. Rouse, Havre de Grace, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 1533 days.

(21) Appl. No.: 11/193,988

(22) Filed: Jul. 28, 2005

(51) Int. Cl.
*F42B 30/04* (2006.01)

(52) U.S. Cl. ..... 102/368; 102/351; 42/105

(58) Field of Classification Search ..... 102/368, 102/503, 351, 352, 382–387; 42/105, 368
See application file for complete search history.

(56) References Cited

U.S. PATENT DOCUMENTS 3,785,569 A * 1/1974 Helmrich ..... 239/337
4,667,601 A * 5/1987 Diamond et al. ..... 102/368
5,171,932 A * 12/1992 McElroy ..... 89/8
6,047,644 A * 4/2000 Malecki et al. ..... 102/367
6,129,024 A * 10/2000 Gerber et al. ..... 102/521
6,250,226 B1 * 6/2001 Leichter et al. ..... 102/370
6,412,416 B1 * 7/2002 Rouse et al. ..... 102/336

* cited by examiner

*Primary Examiner* — Benjamin P Lee
(74) *Attorney, Agent, or Firm* — Ulysses John Biffoni

(57) ABSTRACT

A launchable grenade system is backwards compatible with conventional launch platforms and is capable of launching a variety of payloads at greater range and increased launch velocity, and with significantly improved targeting accuracy. The grenade is pre-packaged in a disposable launch canister that effectively confines launch ejection gases behind the projectile until it exits the canister. Additional enhancements in one or more embodiments, include collapsible aerodynamic stabilizers that are folded inside the launch canister prior to firing and deploy in flight to improve projectile stability and ballistic performance; electronic fuzing for improved repeatability and targeting precision, next-generation digital capabilities that include electronic device identification, failsafe and device monitoring; and momentum arresting forward expulsion of the payload to reduce blunt trauma hazard from projectile hardware and to provide for short distance targeting at significantly greater speed.

25 Claims, 5 Drawing Sheets

LAUNCHABLE GRENADE SYSTEM

GOVERNMENT INTEREST

The invention described herein may be manufactured, licensed, and used by or for the U.S. Government.

TECHNICAL FIELD

The present invention relates generally to small projectiles and more particularly to a launchable grenade system for dispersing payloads such as screening aerosols as well as a wide variety of other fill materials.

BACKGROUND

Launchable grenades are used by military and law enforcement organizations for a number of purposes including, target screening, obscuration, concealment, target marking, crowd control, decontamination, and the like. During military field operations, for example, a unit may be targeted visually or detected by devices that rely on ultraviolet, infrared, millimeter or other electromagnetic radiation. Often the most practical and effective countermeasure involves launching one or more aerosol grenades to set up an aerosol cloud in an effort to confuse such targeting and detection systems. Launchable grenades are also increasingly used for dispensing non-lethal payloads including aerosol irritants, non-penetrating projectiles, pyrotechnic "flash-bang" devices, and the like.

Grenade payloads can include phosphorus, titanium dioxide, and other smoke producing and incendiary materials. Other fill materials include particulates that are designed to disrupt or interfere with electronic detection and guidance systems. For example, aerosols made from carbon fiber particles may be released to block targeting that relies on radar or millimeter wavelength sensors. Brass flakes may be used to interfere with infrared tracking and target acquisition devices. Aerosols such as tear gas or pepper mace are dispersed in crowd control and riot situations. Still other payloads may include aerosol disinfectants, decontaminants, pesticides, fire-retardants, as well as non-penetrating projectiles, including rubber "sting" balls, bean bags, sock rounds and other blunt trauma devices.

Currently fielded launchable grenades include the M81 Screening Grenade, M82 Screening Grenade and M90 pyrotechnic smoke dispenser, the M98 Distraction Grenade, M99 Blunt Trauma Grenade and L96A1 and L97A1 non-lethal grenades. Compatible launch platforms include the M7 Light Vehicle Obscuration Smoke System (LVOSS) and the M6 Countermeasure Discharger (CD). The M7 LVOSS is a 4 tube 66 mm grenade launcher designed to be mounted on light vehicles such as the high mobility multipurpose wheeled vehicle or Humvee and is made from lightweight materials. The M6 CD is a 4-tube 66 mm grenade launcher of heavier construction designed for mounting on armored vehicles.

The conventional 66 mm grenade is housed in a frangible cylindrical body and contains an elongate payload section that includes a compacted annular payload that surrounds a high explosive burster assembly at the center. A propulsion section is positioned beneath the payload section and includes an electric match, a lift charge and a pyrotechnic delay fuze.

When the launch operator activates a firing switch, the conventional 66 mm grenade launcher will deliver a 24 volt direct current signal to contacts located in the base of each grenade. Grenades in the same launcher are wired in parallel so that they will fire at the same time. The 24 volt signal causes the electric match to ignite the lift charge, propelling the grenade from the discharger tube of the launcher. The pyrotechnic fuze is ignited by the burning lift charge and, after a delay, nominally of about 1.7 seconds, the fuze detonates the high explosive burster assembly which ruptures the frangible housing and disseminates the payload.

Although the high explosive burster works well at rapidly disseminating the grenade payload, fragmentation of the housing can pose a hazard to personnel in the vicinity of the blast. Non-explosive payload disseminating mechanisms have been developed to reduce fragmentation hazards, as described in U.S. Pat. No. 6,047,644, to Malecki, et al., granted Apr. 11, 2000 ("'644 patent"), and U.S. Pat. No. 6,412,416 to Rouse, et al., granted Jul. 2, 2002 ("'416 patent"), both of which are incorporated herein by reference as if fully set forth.

Developments such as those described in the '644 and '416 patents have expanded the utility of conventional 66 mm grenades and similar devices, however, a number of problems remain. The conventional 66 mm grenade is not highly accurate given today's requirements, frequently takes too long to disseminate the payload, and has a range that is inadequate for many applications. A number of factors contribute to these performance problems. Although the nominal time of flight to a distance of 30 meters is 1.7 seconds, the time delay of the pyrotechnic fuze of the conventional grenade can vary by as much as 0.4 second, resulting in device detonation anywhere from approximately 22 to 38 meters. Projectile instability causes the device to tumble in flight and the blunt nose shape produces drag, adding to the performance problems and targeting uncertainty of the 66 mm grenade.

Differences in launch platform characteristics further degrade performance and targeting accuracy. These differences can arise from a number of factors, including the fielding of discharger tubes in several different lengths, variability in discharger tube bore diameter caused by temperature changes, repeated firings, or other wear and tear, and the presence of non-uniform drain holes in the base of the discharger tubes which dissipate propulsion energy and vary in size with temperature. While the problems of poor range and launch velocity might be solved by simply increasing the size of the lift charge, structural limitations of the discharger tubes of some launch platforms, such as the lightweight M-7 LVOSS, prevent increasing the size of the lift charge. In addition, increasing the size of the lift charge would likely exacerbate targeting accuracy problems.

Such drawbacks, and others, limit the effectiveness of the conventional 66 mm grenade and other similar munitions in a growing number of applications where greater accuracy, shorter time to target and/or greater range are needed to disseminate a grenade payload with greater effectiveness and reduced risk to non-combatants or friendly forces. Any improvements should also be backwards compatible with existing systems, to the extent practicable. These and other problems are solved, at least in part, by embodiments of grenade systems in accordance with the present invention.

SUMMARY

In general, in one aspect, an embodiment of a system according to the present invention includes a launchable grenade that has a lift charge, a lift charge ignition system, a fuze, a payload expulsion system, and a payload. The grenade is packaged in a disposable launch canister from which it can be launched, that is configured to lock into a discharger tube of a conventional launch platform and has a closed base in which lift charge gases can be confined to increase launch thrust. In another aspect, the launchable grenade system includes a seal, such as an obturator or an o-ring to confine launch gases behind the grenade in the launch canister until the grenade is propelled from the launch canister. In yet another aspect, the launchable grenade system includes a lift charge reservoir positioned at the base of the grenade around which the seal is provided. The lift charge reservoir may be integrated into the base of the grenade or may be configured to separate from the grenade when it is expelled from the launch canister.

In another aspect, an embodiment of a system according to the present invention includes a launchable grenade system that is electrically and mechanically configured for compatibility with existing launch platforms. In another aspect, an embodiment of a system according to the present invention includes a collapsible aerodynamic stabilizer that has a slidable ring around the body of the grenade and a plurality of collapsible fins extending therefrom, is contained within the launch canister before launch, and is configured to slide aft to form a radially flaring tail after the grenade exits the launch canister.

In another aspect, embodiments of systems according to the present invention may expel the payload in several different ways. The payload for example may be expelled from the grenade in a direction that provides a deceleration of the grenade in flight. In other embodiments of systems according to the present invention the payload may be expelled from the grenade in a direction that provides an acceleration of the grenade. In another aspect, the aerodynamic stabilizer is configured to oppose a reverse thrust produced when the payload is forward expelled from the grenade.

In another aspect, embodiments of systems according to the present invention include a launchable grenade having a substantially sealed payload compartment that is configured to dispense the payload with a reduced hazard of fragmentation and shrapnel.

In yet another aspect, the payload compartment includes a member, such as a rupture diaphragm, that is configured to rupture at a predetermined pressure and in which the payload is expelled by building gas pressure within the substantially sealed compartment until the member bursts.

Still another aspect of an embodiment of a system according to the present invention includes a precision programmable electronic fuzing which may include a controller that processes data and instructions comprising one or more of the following: grenade identification, launch initiation, time function, impact function, and self destruct function; determining grenade operability.

Another aspect of the present invention includes a method of launching a grenade, that includes pre-packaging the grenade in a disposable canister from which the grenade can be launched, and which is configured to lock into a discharger tube of a conventional launch platform and be electrically compatible therewith; providing a seal between the grenade and the launch canister that confines launch ejection gases in a substantially sealed chamber behind the grenade until it has exited the canister; equipping the grenade with a collapsible aerodynamic stabilizer that folds inside the launch canister prior to launch and deploys in flight to improve grenade stability and ballistic performance; providing an electronic fuze that is backwards compatible with a conventional launch platform and is also programmable via digital signals that can be multiplexed over the conventional launch platform electrical system.

In yet another aspect, an embodiment of the present invention includes a disposable launch canister for a launchable grenade, that has an elongated substantially smooth bore tube with an opening at the top and a substantially sealed bottom, is dimensioned and configured to be secured within a discharger tube of a grenade launcher, includes an electrical connector that is compatible with a corresponding electrical connector inside the discharger tube and conveys electrical signals to and from a launchable grenade positioned within the launch canister.

In another aspect, an embodiment of the present invention includes a modular insert for retrofitting in a launchable grenade that has an electronic fuze assembly and an electronic detonator to replace a pyrotechnic fuze and detonator of the launchable grenade which improves the targeting accuracy of the launchable grenade. In another aspect, the modular insert is dimensioned for insertion into the base of a conventional 66 mm grenade.

Other aspects, features, and advantages of the present invention will become apparent to those skilled in the art from the detailed description and the accompanying drawings. It should be understood, however, that the detailed description and accompanying drawings, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

A preferred exemplary embodiment of the invention is illustrated in the accompanying drawings in which like reference numerals represent like parts throughout and in which.

DETAILED DESCRIPTION

In the following detailed description, reference is made to the accompanying drawings that form a part hereof, and in which are shown by way of illustration specific embodiments in which the invention, as claimed, may be practiced. This invention may, however, be embodied in many different forms and should not be construed as limited to the embodiments set forth; rather, these embodiments are provided so that this disclosure will be thorough and complete, and will fully convey the scope of the invention to those skilled in the art.

Figure 1:
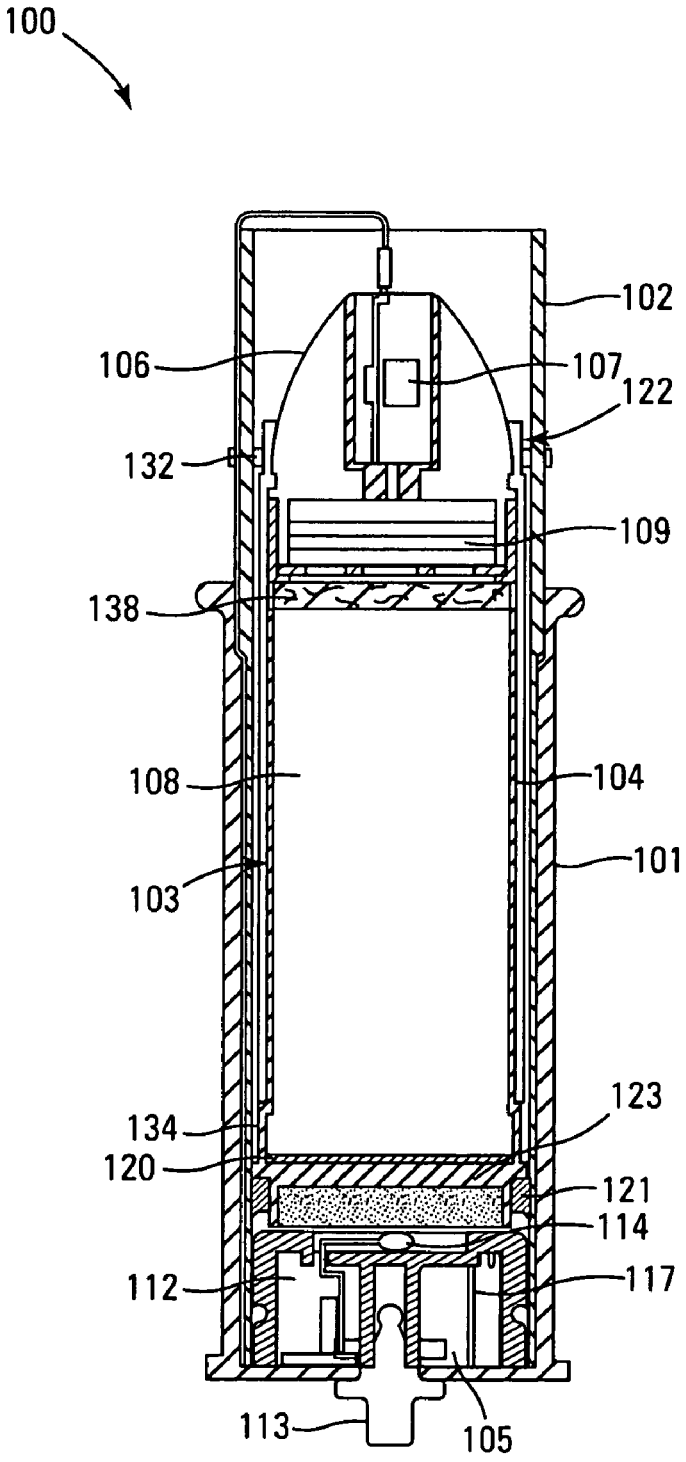
FIG. 1 shows a cross sectional side view schematic of a rear expelling launchable grenade in accordance with a first embodiment of the present invention.

FIG. 1 shows a cross sectional side view of a preferred embodiment of a grenade system 100 according to the present invention. Grenade system 100 is a 66 mm, non-explosive, long range, rear expelling version of the present invention for reaching targets at a range of up to approximately 300 meters. FIG. 1 shows a grenade 103 inside a launch canister 102 positioned for firing from a discharger tube 101 of a conventional grenade launch platform such as an M6 or M7 66 mm vehicle mounted launcher.

Grenade 103 is prepackaged for firing directly from a precision-fit, disposable, launch canister 102. Launch canister 102 is an elongate smooth bore tube that is open at the top and closed at the bottom end to form a base 105. Launch canister 102 is configured to lock into discharger tube 101 in the same manner as a conventional grenade, and is equipped with electrical contacts in base 105 that are compatible with an existing electrical connector 113 that is provided in the discharger tube 101 of current 66 mm launch platforms. To provide uniform launch performance regardless of discharger tube length, launch canister 102 is preferably at least as long as the longest discharger tube in use. In this example, launch canister 102 is approximately 9.88 inches in length (250.99 mm), and has an outside diameter of approximately 2.6 inches (65.79 mm), slightly less than the bore diameter of discharger tube 101. A longer or shorter launch canister may, of course, be employed in alternative embodiments.

Launch canister 102 can be formed from a variety of lightweight impact-resistant material such as a molded or extruded hardened polymer, fiberglass, a metal such as aluminum or steel, composites, or combinations of such materials. Launch canister 102 is configured to withstand the increased radial and longitudinal impulse loads imposed by launch of grenade 103, taking into account structural capabilities of the weakest of the conventional discharger tubes in which it may be deployed. In addition to structural considerations, launch canister 102 should be constructed to protect the grenade during storage and transportation.

A tubular projectile case 104 forms the body of grenade 103. Projectile case 104 includes a tapered nose cone 106 at the top and a cylindrical payload section 108 underneath. The outside diameter of projectile case 104 is somewhat smaller than the inside diameter of launch canister 102 to accommodate a collapsible aerodynamic stabilizer 122 on the outside of grenade 103 and described below. Payload section 108 provides a cylindrical storage compartment capable of holding 310 cc. In general, payload section 108 may contain any substance, material or device which is desired to be delivered to a target area using a projectile according to the present invention as the carrying and dispersing device. Payload materials may include, but are not limited to, substances capable of being dispersed in the form of an aerosol, electronic sensors and devices, unmanned aerial vehicles, flash-bang munitions, sting balls, ground sensors, mines, bomblets, concussion grenades, tire puncturing elements, signal emitting devices, disinfectants, decontaminants and fire-retardants. The aerosol substance is preferably selected from the group consisting of smoke, crowd control agents, obscurants, target marking compounds, dyes and inks, chaffs and the like. Of course, all payload materials will be in compliance with national and international laws, treaties, and agreements to which the United States is a party.

Projectile case 104 rests upon a lift charge cup 123 which provides a downward facing cup or disk shaped reservoir that contains an enhanced lift charge, preferably comprising 18 grams of a black or smokeless powder or similar composition. Lift charge cup 123 is dimensioned and configured to slide inside launch canister 102 and to accumulate expanding launch gases beneath it to drive the grenade 103 out of launch canister 102. A groove or notch is provided in the external sidewall of lift charge cup 123 for securing a seal or obturator ring 121. Obturator ring 121 provides a flexible seal against the inside wall of launch canister 102 and improves confinement of launch gases to the area of launch canister 102 beneath grenade 103. Obturator ring 121 may be made from a thermoplastic resin or a fluoroelastomer, or another suitable material. In alternative embodiments, an o-ring seal may be used.

Figure 2:
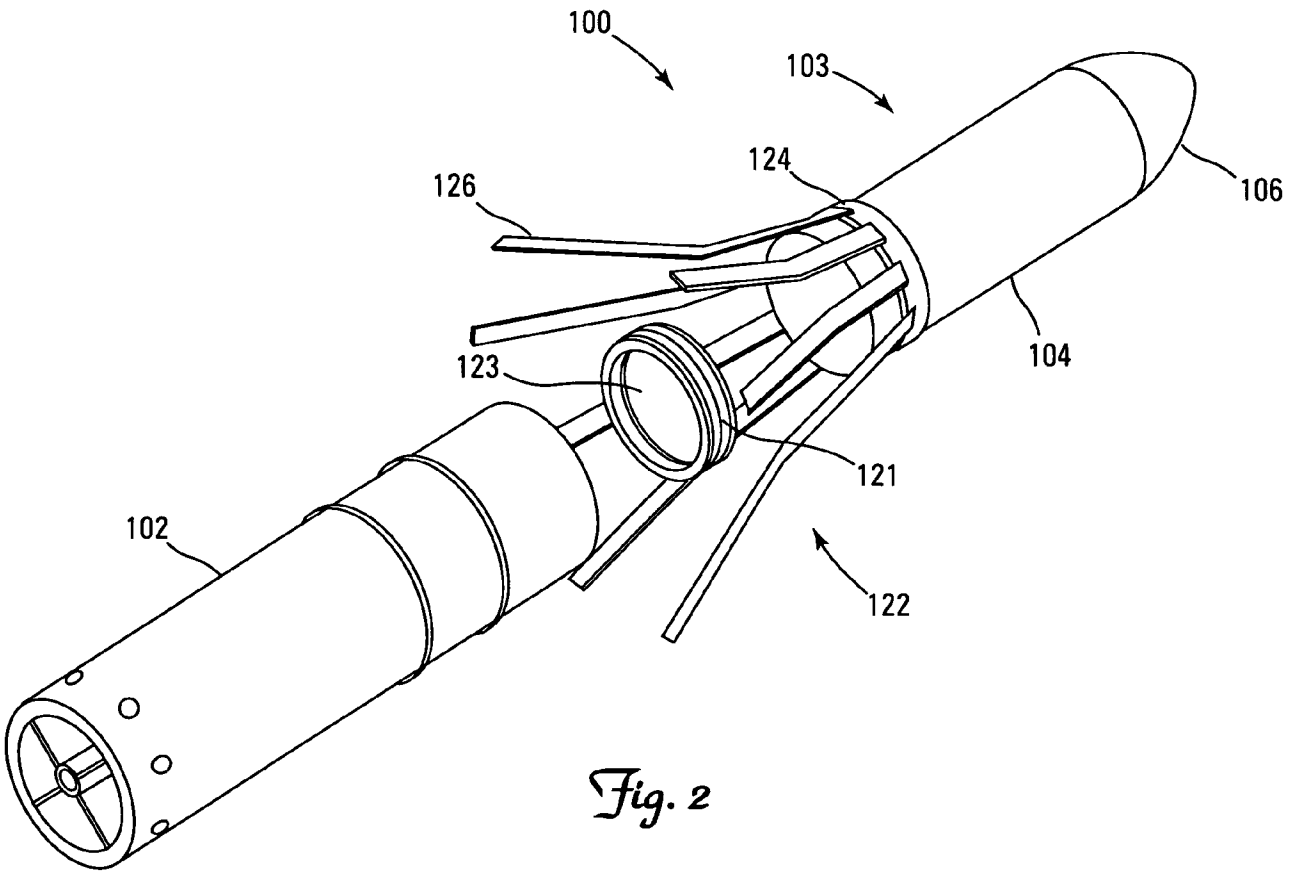
FIG. 2 shows a perspective view of a rear expelling launchable grenade in an in-flight configuration, in accordance with a first embodiment of the present invention.

Projectile case 104 is preferably made from a lightweight metal, plastic or composite material that provides sufficient strength to withstand the forces of launch and payload dissemination. The sidewall portions of projectile case 104 are preferably fabricated from a material such as 7075-T6 AL aluminum tube which will resist fragmentation when the grenade functions. To disseminate the payload, projectile case 104 preferably includes a burst diaphragm or burst panel that is configured to pop open, rupture or separate when an appropriate internal pressure has been reached. For a rear eject device such as depicted in FIGS. 1 and 2, a rear burst diaphragm 120 made from a plastic, metal film or composite material is provided at the bottom of payload section 108. Similarly, a forward eject device such as the device shown in FIGS. 3 and 4 includes a forward burst diaphragm 320 at the top of payload section 308. Other embodiments may provide a burst diaphragm or burst panel in a sidewall of projectile case 104 to provide for expulsion of the payload in a different direction.

Base 105 is positioned immediately beneath lift charge cup 123 and generally will remain in launch canister 102 after grenade 103 has been fired. While base 105 is shown as a separate component, it may be integrated with launch canister 102 in alternative embodiments. Base 105 includes an electronic lift module 112 and an electronic discharger interface and controller module 117. In response to a firing signal from the launcher, electronic lift module 112 starts an electronic or "E-match" 114 at the top of base 105 to ignite the adjacent lift charge.

The electronic discharger interface and controller 117 is configured to be compatible, both electrically and mechanically, with electrical connector 113 at the bottom of discharger tube 101. Connector 113 provides supply and signal voltages from the arming/firing unit of the launcher for programming and pre-launch configuration, device charging and precision setting, arming and launching of grenade 103 from grenade system 100. Electronic discharger interface and controller 117 can communicate with and be programmed via digital signals multiplexed over a conventional launch platform electrical system and received through electrical connector 113 and will also maintain compatibility with existing 24 volt launch systems. Where next generation digital electronic systems are not available, the grenade may be configured and fired in the same way as a conventional 66 mm device. Next-generation digital capabilities where available, may include failsafe and monitoring systems to prevent unauthorized or accidental use of the grenade, systems to identify the grenade, the payload, condition of the payload, grenade performance specifications, age of the grenade, its condition and operability, and the like. Other advanced functions may include pre-launch monitoring systems, and post-launch systems that check for the presence of non-functioning devices in the launcher.

For a rear expelling device, such as grenade system 100 of FIGS. 1 and 2, payload expulsion is performed by an electronic burst module 107 positioned forward of payload section 108 in nose cone 106. Electronic burst module 107 includes a precision electronic time delay fuze that ignites a payload expelling gas generator assembly 109. Accuracy of the electronic time delay fuze is the range of 1/1000 sec., substantially eliminating targeting errors resulting from fuze time delay inaccuracy. Electronic burst module 107 may be configured by signals communicated via electronic discharger interface and controller 117. Gas generator assembly 109 is coupled to payload compartment 108 at one end. A felt disc 138 is positioned between gas generator assembly 109 and the payload to avoid ignition of the payload. Payload compartment 108 is substantially air-tight and is equipped with a burst diaphragm 120 on the end opposite to gas generator assembly 109. Burst diaphragm 120 is configured to rupture at a pressure that will effectively and rapidly expel and disseminate the payload to a target zone and at the same time result in minimal fragmentation of projectile case 104.

Launchable grenades according to the present invention preferably will provide multiple fuze modes for added safety and assurance of success. For example, systems according to the present invention should be programmable to function under both time delay and impact modes to ensure that devices will detonate even if there is a failure of one or the other fuze mode. Fuze modes including proximity, heat, deceleration, and the like, may also be provided in alternative embodiments.

Grenade system 100 further includes a collapsible aerodynamic stabilizer that deploys in flight to improve dynamic stability of the projectile and further extend range capabilities. Referring to FIG. 2 which show an exploded view of grenade system 100 with grenade 103 in an in-flight configuration, a collapsible aerodynamic stabilizer 122 is formed of a number of longitudinal fins 126 attached on end to a sliding collar 124 that encircles projectile case 104. Fins 126 are spaced about the circumference of projectile case 104 and preferably made of a flat, vane-like, compressible resilient material such as spring steel. Other resilient materials that regain their original shape after periods of compression, including metals, plastics, or composites may also be employed.

Before the grenade is launched, fins 126 are packed inside the launch canister 102. Collar 124 is initially positioned against a forward stop 132 at the base of nose cone 106 and fins 126 lie around and alongside of projectile body and are biased against the inside surface of launch canister 102. As grenade 103 exits launch canister 102 frictional and inertial forces urge sliding collar 124 and attached fins 126 aft until collar 124 has reached a rear stop position 134 and attached fins 126 have extended in a tail past the rear of the projectile case 104. After grenade 103 is free of launch canister 102 fins 126 are able to spring out radially beyond the projectile slipstream to form a shuttlecock-like tail that stabilizes the projectile. While fins 126 are preferably made from a spring-like material, alternative embodiments may employ folded, compressed, or collapsed struts, arms, vanes, or similar collapsible aerodynamic stabilizers. In other alternative embodiments of the present invention, stabilizing fins or projections may be actuated, deployed or extended electronically or in response to inertial, rotational or aerodynamic forces.

Figure 3:
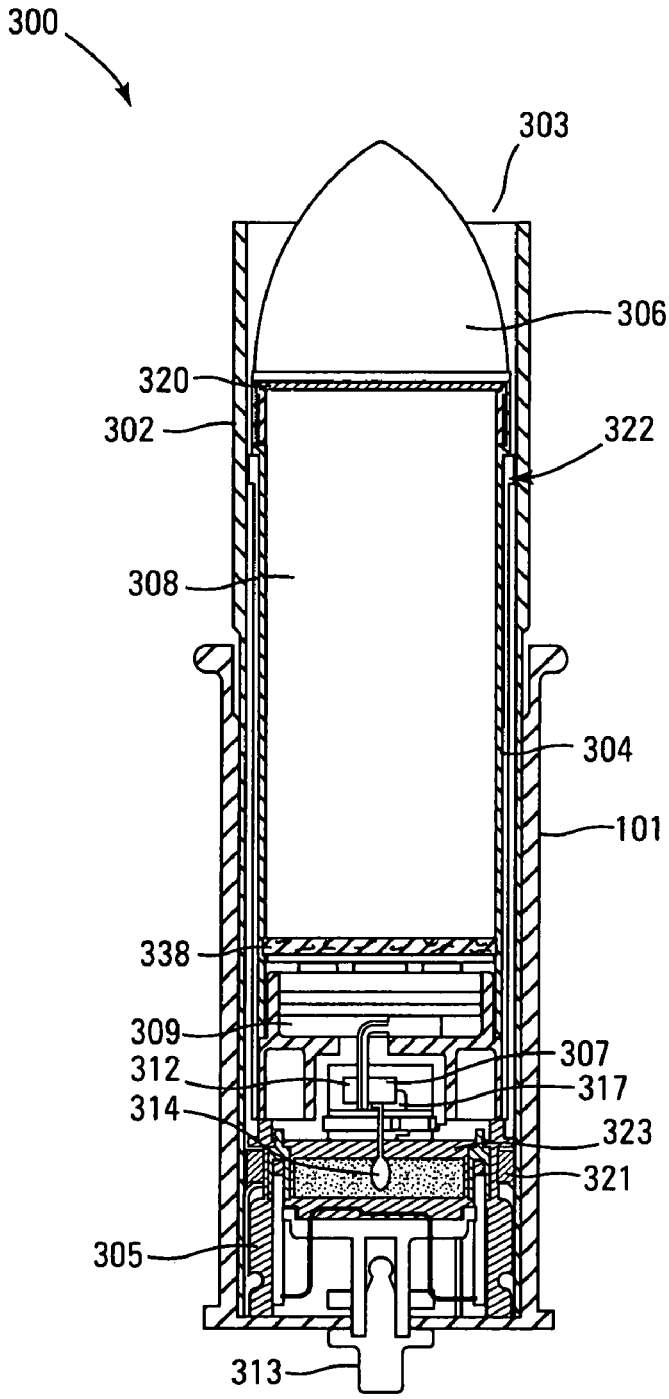
FIG. 3 shows a cross sectional side view of a forward expelling launchable grenade in accordance with an alternative embodiment of the present invention.

FIG. 3 shows a cut away side view schematic of an alternative embodiment of a 66 mm launchable grenade system 300 in accordance with the present invention. Launchable grenade system 300 represents a 66 mm forward expelling non-explosive version of the present invention and has been configured for rapid deployment to targets at ranges of 30 to 300 meters. Launchable grenade system 300 is similar to the embodiment shown in FIGS. 1 and 2. Accordingly, like numbers have been used to describe like parts where appropriate and various details in common will not be repeated. As in the previous embodiment, grenade system 300 provides a grenade 303 that is prepackaged for firing directly from a precision-fit, disposable, launch canister 302. A tubular projectile case 304 forms the body of grenade 303. Launch canister 302 is configured to lock into discharger tube 101 in the same manner as a conventional grenade. Launch ejection gases are confined in the closed base 305 of launch canister 302 beneath a lift charge cup 323 underlying grenade 303. Lift charge cup 323 is encircled by an obturator ring 321. In contrast to the rear expelling embodiment of FIGS. 1 and 2, lift charge cup 323 may be integrated with the base of grenade 303 since the payload will be expelled forward in this embodiment.

A payload section 308, which provides the same capacity as payload compartment 108, is configured for forward expulsion of the payload. A gas generator assembly 309 of grenade system 300 is positioned beneath payload section 308 and a forward burst diaphragm 320 is provided on top of payload section 308. A removable nose cone 306, preferably of a very light material such as balsa wood, tapered to improve aerodynamic performance is provided on top of grenade 303.

The increased launch velocity of grenade system 300 provides proportionately greater forward momentum. In applications where it is desirable to impact a target with as much force as possible, the increased forward momentum will be advantageous. However, a growing number of applications favor a grenade system that has the ability to disseminate a payload in a target zone with a minimum of fragmentation hazard, explosive burst, and impact force. Grenade system 300 is configured to reduce or eliminate the force of impact of the projectile by reducing projectile momentum in flight when the device is at or near the target. Grenade 303 reduces projectile forward momentum by a reverse thrust produced when the payload is forward expelled at or near the target. The reverse thrust is minimized by the braking action of the tail fins, decelerating the projectile in close proximity to the target so that the grenade body 304 drops to the ground with minimal momentum after device function. Forward expulsion of the payload according to this embodiment thus reduces the risk of personnel blunt trauma without adding to the time it takes the projectile to reach the target. In alternative embodiments, projectile deceleration may be augmented by deploying a parachute, drag chute, airfoil, speed brake, or other drag producing device.

As in the first embodiment, an electronic lift module 312 fires an e-match 314 at the top of base 305 to ignite the lift charge in lift charge cup 323. An electronic discharger interface and controller module 317 provides signaling and communications interface with the launcher as in the embodiment described above.

A burst module 307 of grenade system 300 is housed beneath payload section 308 and positioned with electronic lift module 312 and electronic discharger interface and controller module 317. Burst module 307 includes a precision electronic time delay fuze that ignites a payload expelling gas generator 309 as in the reverse expelling embodiment.

Figure 4:
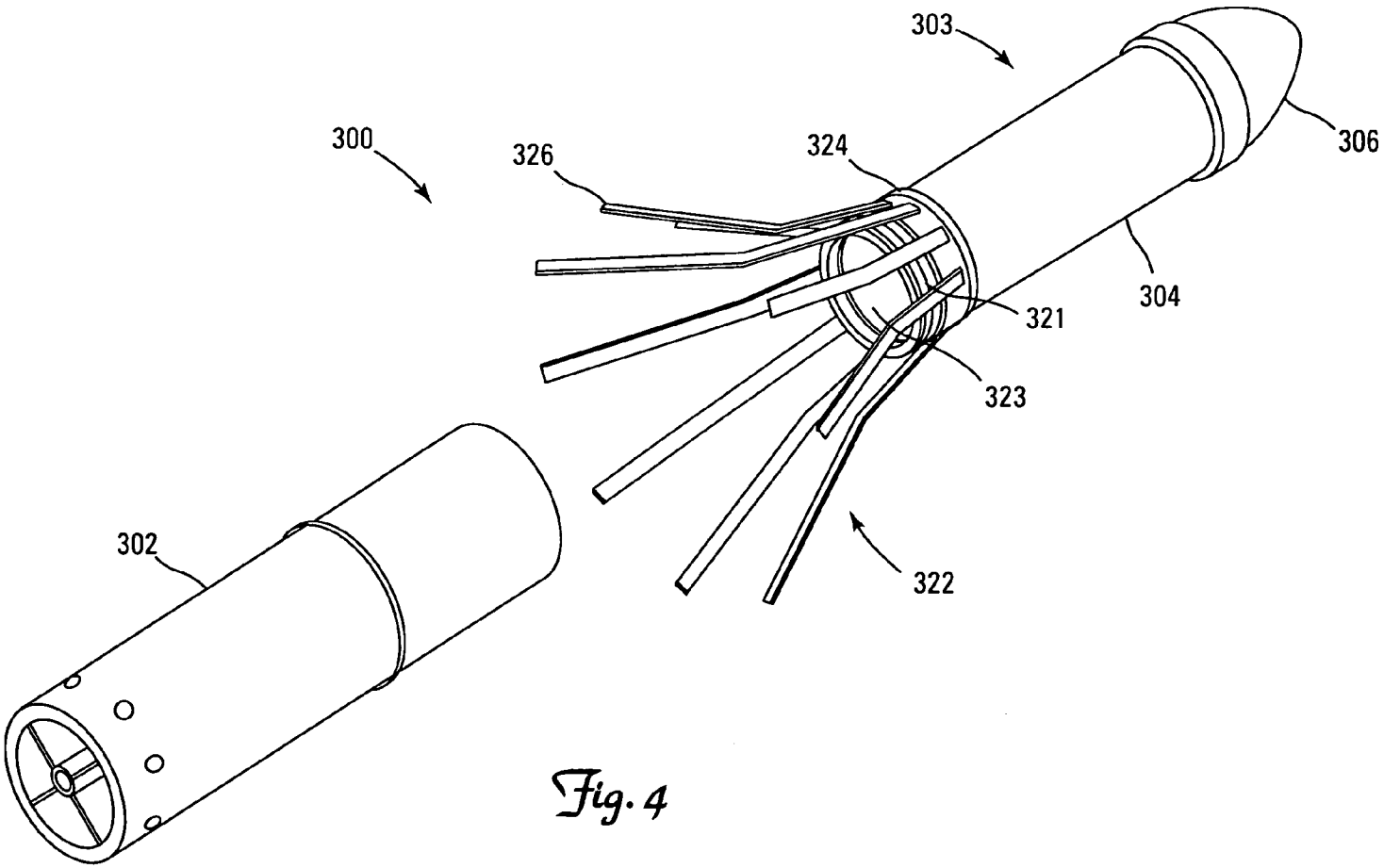
FIG. 4 shows a perspective view of a forward expelling launchable grenade in an in-flight configuration, in accordance with an alternative embodiment of the present invention.

FIG. 4 shows an exploded view of forward expelling embodiment 300 with grenade 303 in an in-flight configuration. As in the rearward expelling embodiment, grenade 303 is equipped with a collapsible aerodynamic stabilizer assembly 322 formed of a number of longitudinal fins 326 attached on end to a sliding collar 324 that encircles projectile case 304. While fins 326 are generally of the same construction as fins of the reverse expelling embodiment.

In operation of an embodiment of a grenade system according to the present invention, a grenade 103, 303 that is packaged in a launch canister 102, 302 is hand loaded into a discharger tube 101 and locked into a socket at the bottom of the discharger tube to connect electrically to the arming/firing system of the launcher. Just prior to launch, a 24 Vdc current is applied to the grenades to charge the firing circuits. After the fuze is charged the current is automatically applied to the e-match 114, 314 to ignite the lift charge. In next generation launchers, low voltage digital signals may be used to set fuze delays, provide arming options to the grenade and communicate cartridge type and status information to the launcher.

The lift charge of each grenade burns, rapidly building pressure of propellant gases behind the grenade lift charge cup 123, 323 and obturator 121, 321. The focused energy of this expanding column of gases drives grenade 103, 303 piston-like from the launch canister 102, 302 at significantly increased velocity compared to conventionally launched grenades. As grenade 103, 303 exits launch canister 102, 302 a "launch separation signal" is provided by a sensor or switch. The launch separation signal is sensed by or communicated to the programmable electronic fuze and the pre-programmed time of flight delay countdown is initiated arming the device. Launch canister 102, 302 is retained in the launcher after function.

As the grenade 103, 303 exits the launch canister 102,302, aerodynamic stabilizer 122, 322 slides aft and stabilizer fins 126, 326 flare out radially to form a tail similar to the tail of a badminton shuttle cock. The cartridge travels downrange along a stable, tumble free trajectory.

When the preprogrammed delay expires the electronic fuze triggers the e-match 114, 314 igniting the gas generator 109, 309, to build pressure in payload compartment 108, 308 until burst diaphragm 120, 320 ruptures expelling the payload in flight. The payload is expelled forward, to the rear, or radially, depending on device configuration. If the projectile impacts the ground or other structure before the flight delay fuze times out, the sudden deceleration may be sensed in the fuze so the grenade will function immediately.

Figure 5:
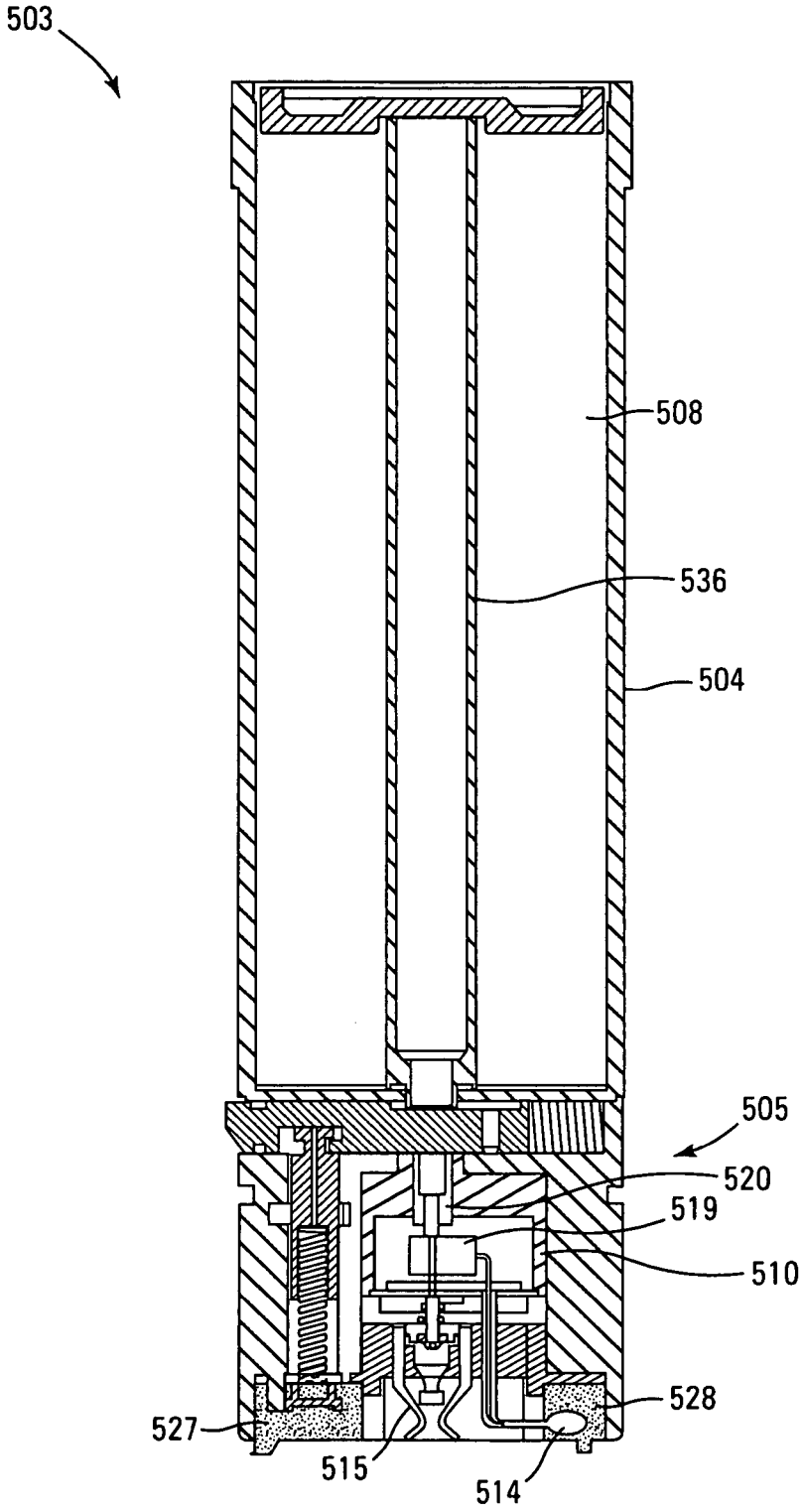
FIG. 5 shows a cross sectional side view of a radially expelling electronically fuzed launchable grenade in accordance with an alternative embodiment of the present invention.

FIG. 5 shows a cut away side view schematic of an additional alternative embodiment of a 66 mm grenade 503 in accordance with the present invention. Grenade 503 is an explosive, radially expelling version of the present invention and is configured for deployment to short and medium range targets in the range of approximately 30 to 100 meters. Grenade 503, which is substantially the same in external appearance as conventional 66 mm launchable grenades and incorporates many of the same components where possible, includes a blunt nosed projectile case 504 that provides a payload section 508 and a base section 505 underneath. Grenade 503 differs primarily from the conventional devices by its high velocity lift charge 527, its state of the art programmable electronic fuze assembly 519 and an electronic detonator 520 which take the place of the conventional pyrotechnic fuze. Electronic fuze assembly 519 and electronic detonator 520 are contained within a modular insert 510 that is dimensioned for retrofitting in conventional 66 mm grenades and provides standard contacts 515 that are mechanically and electrically compatible with conventional 66 mm lift charge platforms. An e-match 514 on a short flexible lead extends from the bottom of modular insert 510 and is positioned in a lift charge reservoir 528 at the bottom of base 505 to ignite a lift charge 527 preferably comprising black or smokeless powder.

The embodiment shown in FIG. 5 employs a conventional high explosive burster assembly 536 to dissimilate the payload. High explosive burster assembly 536 is positioned at the center of payload section 508 for substantially omni-directional payload dissemination and is initiated by the electronic detonator 520 in response to a signal issued by electronic fuze 519. The high accuracy electronic fuze 519 can be configured electronically for time delays ranging between 0.100 to 9.999 seconds. Electronic fuze 519 is preferably controlled by a programmable microprocessor and may include in one or more embodiments functions that include failsafe and encryption systems to prevent unauthorized or accidental use of the grenade, systems to identify the grenade, by payload type and condition, by device performance specifications, device age, condition, operability and the like. Other advanced functions may include pre-launch configuration and monitoring systems, and post-launch systems that indicate the presence of a non-functioning device in the launcher.

CONCLUSION

Embodiments of launchable grenades and grenade launch systems according to the present invention provide significant improvements over existing grenade launch systems and are capable of achieving reduced time to target, longer range, and greater launch stability, improved ballistics and targeting accuracy. The grenades are easier to launch and may be equipped with next generation digital systems that provide additional arming options, device identification and a variety of safety checks. Embodiments of grenades according to the present invention not only demonstrate greater launch velocity and targeting distance, but also exhibit flight characteristics that are more predictable and repeatable, resulting in fewer targeting errors.

It will be clear to one skilled in the art that the above embodiments may be altered in many ways without departing from the scope of the invention. For example, while 66 mm diameter cartridges have been described, embodiments of the present invention may be scaled to other caliber grenade systems. Alternative embodiments may incorporate other types of fuzes and initiators, including mechanical or electronic time delay devices, point detonating, impact, proximity and GPS based fuzes, and the like. Additionally, embodiments according to the present invention may be designed for forward, rear or radial expulsion of the grenade payload. Accordingly, the scope of the invention should be determined by the following claims and their legal equivalents.

What is claimed is:

1. A launchable grenade system, comprising:

a launchable grenade having a lift charge, a lift charge ignition system, a fuze, a payload expulsion system, and a payload; and a disposable launch canister in which said grenade is packaged and from which it can be launched, configured to lock into a discharger tube of a conventional launch platform, said launch canister providing a closed base in which lift charge gases can be confined to increase launch thrust.

2. The launchable grenade system of claim 1, wherein said launch canister is configured to increase the blast handling capacity of said discharger tube to permit use of an enhanced lift charge.

3. The launchable grenade system of claim 1, further comprising a seal to confine launch gases behind said grenade in said launch canister until said grenade is propelled from said launch canister.

4. The launchable grenade system of claim 3, wherein said seal comprises an elastomeric material.

5. The launchable grenade system of claim 3, wherein said seal comprises an obturator ring.

6. The launchable grenade system of claim 3, further comprising a lift charge reservoir positioned at the base of the grenade around which said seal is provided.

7. The launchable grenade system of claim 6, wherein said lift charge reservoir is configured to separate from said grenade when it exits said launch canister.

8. The launchable grenade system of claim 1, wherein said launchable grenade system is electrically and mechanically configured for compatibility with existing launch platforms.

9. The launchable grenade system of claim 1, further comprising a collapsible aerodynamic stabilizer positioned on said grenade.

10. The launchable grenade system of claim 9, wherein said collapsible aerodynamic stabilizer is contained with said grenade in said launch canister to facilitate device storage, handling and pre-launch configuration.

11. The launchable grenade system of claim 9, wherein said collapsible aerodynamic stabilizer comprises a sliding ring encircling the body of said grenade and a plurality of collapsible fins extending therefrom.

12. The launchable grenade system of claim 11, wherein said fins comprise a resilient material.

13. The launchable grenade system of claim 11, wherein said aerodynamic stabilizer is configured to slide aft to form a radially flaring tail after said grenade exits said launch canister.

14. The launchable grenade system of claim 1, wherein said payload is expelled from said grenade in a forward direction that provides a deceleration of said grenade in flight.

15. The launchable grenade system of claim 9, wherein said aerodynamic stabilizer is configured to oppose a reverse thrust produced when said payload is forward expelled from said grenade.

16. The launchable grenade system of claim 15, wherein said aerodynamic stabilizer comprises a radially flaring tail.

17. The launchable grenade system of claim 1, wherein said payload is expelled from a substantially sealed compartment that is configured to dispense said payload with a reduced hazard of fragmentation and shrapnel.

18. The launchable grenade system of claim 17, wherein said substantially sealed compartment comprises a member that is configured to rupture at a predetermined pressure.

19. The launchable grenade system of claim 18, wherein said member that is configured to rupture at a predetermined pressure comprises a rupture diaphragm.

20. The launchable grenade system of claim 18, wherein said predetermined pressure is developed by a gas generator.

21. The launchable grenade system of claim 1, wherein said fuze comprises an electronic fuze.

22. The launchable grenade system of claim 21, wherein said electronic fuze comprises a controller that processes data and instructions comprising one or more of the following: performing grenade identification, launch initiation, time function, impact function, self destruct function; and determining grenade operability.

23. The launchable grenade system of claim 1, wherein said lift charge comprises an enhanced lift charge to provide greater thrust during launch.

24. The launchable grenade system of claim 1, wherein said launch canister is constructed to protect the grenade during storage and transportation.

25. A launchable grenade system, comprising:

a launchable grenade having a lift charge, a lift charge ignition system, a fuze, a payload expulsion system, and a payload;

a disposable launch canister in which said grenade is packaged and from which it can be launched, configured to lock into a discharger tube of a conventional launch platform and be substantially electrically and mechanically compatible therewith;

said launch canister providing a closed base in which lift charge gases can be confined to increase launch thrust, and configured to increase the blast handling capacity of said discharger tube to permit use of an enhanced lift charge;

a seal configured to confine launch gases behind said grenade in said launch canister until said grenade is propelled from said launch canister;

a lift charge reservoir positioned at the base of said grenade around which said seal is provided; and a collapsible aerodynamic stabilizer contained in said launch canister configured to slide aft to form a radially flaring tail after said grenade exits said launch canister.

* * * * *